United States Patent [19]

McGonigal

[11] Patent Number: 4,638,559

[45] Date of Patent: Jan. 27, 1987

[54] METHODS OF AND APPARATUS FOR MAKING SLOTTED BEAM CONTACT ELEMENTS

[75] Inventor: Charles McGonigal, Grayson, Ga.

[73] Assignee: AT&T Technologies, Inc., Berkeley Heights, N.J.

[21] Appl. No.: 666,526

[22] Filed: Oct. 30, 1984

[51] Int. Cl.[4] ..... H01R 43/16

[52] U.S. Cl. ..... 29/874; 29/33 M; 29/882; 339/97 R

[58] Field of Search ..... 29/882, 33 M, 874; 72/412; 339/97 R, 97 P, 276 T, 276 SF

[56] References Cited

U.S. PATENT DOCUMENTS

| | | | |
|---|---|---|---|
| 3,707,932 | 1/1973 | Murray | 29/874 |
| 3,798,587 | 3/1974 | Ellis, Jr. et al. . | |
| 3,858,158 | 12/1974 | Henn et al. . | |
| 3,918,790 | 11/1975 | Filson . | |
| 3,945,709 | 3/1976 | Filson . | |
| 4,136,628 | 1/1979 | McGonigal et al. . | |
| 4,211,099 | 7/1980 | McGonigal et al. | 29/882 X |
| 4,350,405 | 9/1982 | Yapoudjian et al. . | |
| 4,421,374 | 12/1984 | Montilla, Jr. et al. . | |
| 4,472,596 | 9/1984 | Brown et al. . | |

FOREIGN PATENT DOCUMENTS

| | | | |
|---|---|---|---|
| 1398164 | 6/1975 | United Kingdom | 29/882 |

*Primary Examiner*—Howard N. Goldberg
*Assistant Examiner*—Carl J. Arbes
*Attorney, Agent, or Firm*—E. W. Somers

[57] ABSTRACT

A slotted beam contact element (13) for an electrical connector is constructed by forming an opening in a metallic strip (31) and then, if necessary, reshaping at least one portion of the strip which defines the opening. Then a bifurcated beam (14) is formed in the strip with the opening being disposed between at least portions of inner edge surfaces of the furcations (15—15) of the beam after which the furcations are moved toward each other. Forces are applied to the furcations at locations (38—38) along a major surface (35) of the strip adjacent to outer edge surfaces (37—37) of the furcations to cause the inner edge surfaces to define a slot having a predetermined configuration.

13 Claims, 16 Drawing Figures

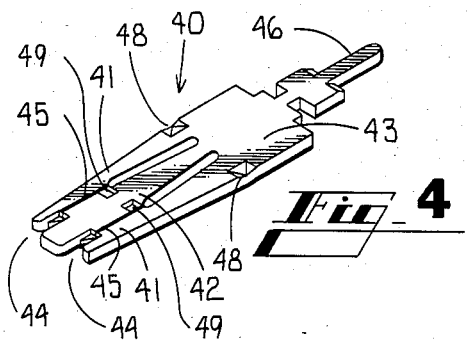
Fig. 4
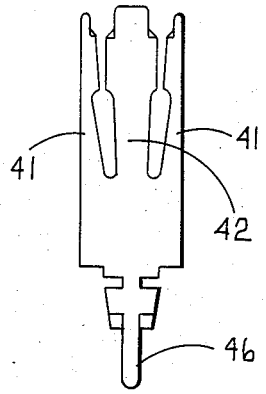
Fig. 6A
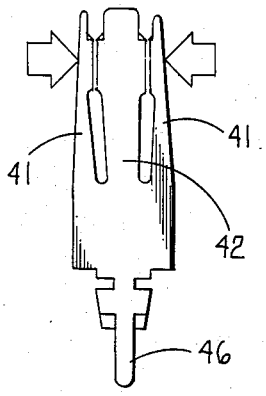
Fig. 6B
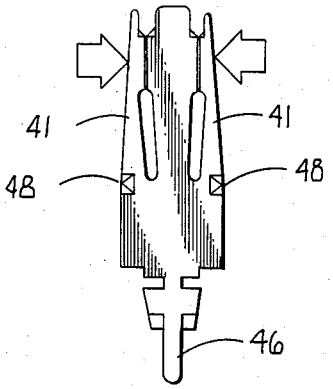
Fig. 6C
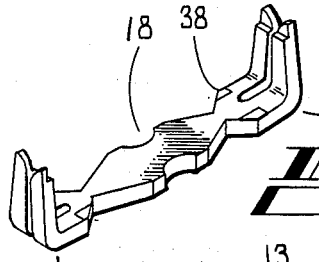
Fig. 1B
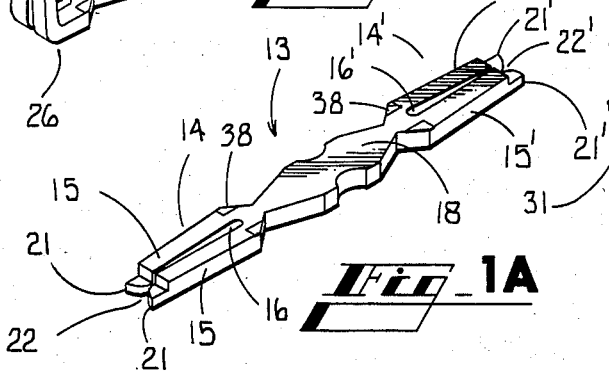
Fig. 1A
Fig. 3
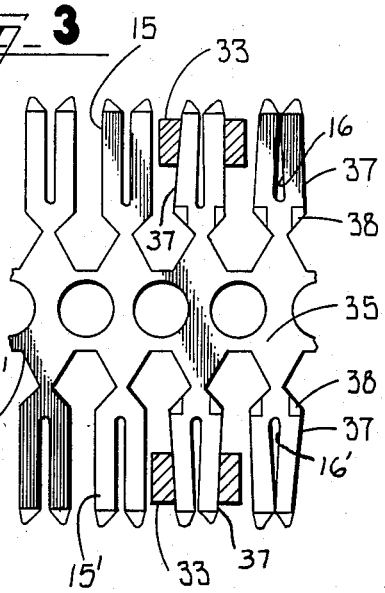

113
108
109
100
107
104
90
103
103
91
91
50
80
87
81
83
86
72
82
72
71
71'
75

64
63
61
62
62'
60
64'
51
146
146
165
146
144
142
144
141
141
53
53'
54
54'
52
52'
53
55
56
55'
53'
160

METHODS OF AND APPARATUS FOR MAKING SLOTTED BEAM CONTACT ELEMENTS

TECHNICAL FIELD

This invention relates to methods of and apparatus for the manufacture of slotted beam contact elements for making electrical connections between conductors. More particularly, it relates to the manufacture of an insulation-penetrating, furcated beam contact element from a metallic strip with furcations of each beam defining a conductor-receiving slot having a predetermined configuration.

BACKGROUND OF THE INVENTION

In the communications industry where it becomes necessary to interconnect seemingly countless numbers of insulated conductors, solderless electrical connectors are used widely. One type of solderless connector generally includes an electrically conductive element, which is commonly referred to as a slotted beam contact element and which comprises a waist portion having a beam extending from opposite sides thereof with each of the beams bifurcated to provide a slot for receiving an insulated conductor. See, for example, U.S. Pat. No. 3,798,587 issued Mar. 19, 1974 to B. C. Ellis, Jr. et al and U.S. Pat. No. 3,858,158 issued Dec. 31, 1974 in the names of R. W. Henn et al. The spacing between the furcations of each beam is such that facing, inner edge surfaces thereof which define the slot penetrate the insulation of an insulated conductor which is moved into the slot to establish electrical engagement between the conductor and the furcations. Because of their resiliency, the bifurcated portions of the beam tend to move toward each other after a conductor has been moved into the slot to clamp the conductor tightly.

In the prior art, slotted beam contact elements have been formed along a metallic strip by the step of punching the strip to form central waist portions having beams extending bilaterally thereof. Each beam may be lanced to bifurcate the beam with opposing lanced surfaces of the furcations defining a conductor-receiving slot. The step of lancing invariably moves one of the furcations out of the plane of the contact element thereby impairing the connection process when a conductor is moved into the slot. Also, the step of lancing makes it difficult to control the shape of the opposing lanced surfaces of the furcations which define the slot, and forms burrs on the lanced surfaces which may deform a condcutor that is moved into the slot. In the alternative, each conductor-receiving slot is formed by punching a narrow slot in a beam; however, difficulties have been encountered in punching narrow width slots through relatively thick strips of metal.

Inasmuch as conductors which are connected with slotted beam contact elements are exposed to a wide range of conditions, the conductors are insulated with different materials. Rather than manufacture different kinds of slotted beam contact elements which are usable with different types of insulation, it is more economical to manufacture a contact element which is capable of tearing, penetrating or slicing through a variety of types of insulation to establish an electrical connection and which is capable of maintaining a tight connection. This is accomplished by shaping the opposing inner edge surfaces of the beam furcations to a predetermined configuration. However, as noted hereinbefore, the satisfactory shaping of these surfaces has not been accomplished when the furcations are formed by the step of lancing or by the punching of a narrow slot in the beam.

Also, it may be important that the inner edge surfaces of the furcations be plated with a corrosion-resistant material such as, for example, gold or solder. This is difficult to do in the conventional process of forming the beams and then lancing them to provide the slots because of the relatively small gap between the furcations.

These problems have been overcome to some extent by the techniques shown in U.S. Pat. No. 4,136,628, which issued on Jan. 30, 1979 in the names of C. McGonigal and J. E. Voytko and which is incorporated by reference hereinto. Contact elements are configured along a strip which is moved through a plurality of work stations of a punch and die apparatus. The forming is accomplished such that the furcations at each end of each beam are spaced apart. This allows the facing furcation edge surfaces at each end to be specially configured after which the furcations are moved toward each other and then pivoted about their free end portions, which are touching, to form a slot having a predetermined configuration.

Although the just-described technique provides contact elements having a desired slot configuration, it is not desirable to have the end portions of the furcations act as pivot points for the closing. This may cause damage to those end portions and result in deformed entrances to the conductor-receiving slots between the furcations. What is needed and what seemingly is not provided by the prior art are methods and apparatus for making contact elements first with the furcations in an open position to allow configuring and then for closing them without damaging them.

SUMMARY OF THE INVENTION

The foregoing problems are overcome by the methods and apparatus of the present invention. A method of making a slotted beam contact element includes the steps of forming an opening in a metallic strip having major surfaces which are connected by edge surfaces extending along the thickness of the strip, and then forming a furcated beam in the strip with the furcations of the beam being spaced apart and with the opening being disposed between at least portions of inner edge surfaces of the furcations. Then, forces are applied to the strip at least at one location along at least one of the major surfaces and adjacent to an outer edge surface of a furcation. The forces cause relative movement between the furcations to reduce the spacing therebetween and to cause portions of the inner edge surfaces to define a conductor-receiving slot having a predetermined configuration.

In another embodiment, relative movement is caused to occur between the furcations to cause portions of the inner edge surfaces of the furcations to define a conductor-receiving slot. Then at a predetermined time with respect to the relative movement, forces are applied to the strip at locations along a major surface and adjacent to outer edge surfaces of the furcations to set the furcations and to cause the slot to have a predetermined configuration.

By means of the foregoing steps, the furcations of each beam are maintained in one plane and the surfaces which define the conductor-receiving slot advantageously may be shaped in order to improve the initial and prolonged electrical contact of the furcations with a conductor. Because of the accessibility of the inner edge surfaces when the furcations are in the open position, the surfaces may be treated, such as, for example, by plating in order to enhance their electrical contact.

In accordance with another aspect of the invention, an apparatus for making a slotted beam contact element includes facilities for forming an opening in a metallic strip, having major surfaces which are connected by edge surfaces extending along the thickness of the strip. Facilities are provided for forming a furcated beam in the strip with the furcations of the beam being spaced apart and with the opening being disposed between at least portions of inner edge surfaces of the furcations. The apparatus also includes facilities for causing relative movement between the furcations to reduce the spacing therebetween and cause ends of the furcations to be in proximate engagement with each other and to define a slot for receiving a conductor with free end portions of the furcations defining an entrance to the slot. Facilities are provided to be rendered effective at a predetermined time with respect to the relative movement between the furcations for applying forces perpendicular to a major surface of the strip at locations adjacent to outer edge surfaces of the furcations to cause the slot which is defined by the furcations to have a predetermined configuration.

BRIEF DESCRIPTION OF THE DRAWINGS

Other objects and features of the present invention will be more readily understood from the following detailed description of specific embodiments thereof when read in conjunction with the accompanying drawings, in which:

FIGS. 1A and 1B are perspective views of contact elements which are provided by this invention;

FIG. 3 is a view of the insulation-penetrating slotted beam contact element of FIG. 1A illustrating the methods of this invention to provide a conductor-receiving slot having predetermined characteristics;

FIG. 4 is a perspective view of a trifurcated contact element made by the methods and apparatus of this invention;

FIGS. 6A–6C are a sequence of views of the contact element of FIG. 4 to show a sequence of steps in its manufacture;

DETAILED DESCRIPTION OF THE INVENTION

Referring now to FIG. 1A, there is shown an insulation-penetrating, slotted beam contact element, designated generally by the numeral 13. It is made of a metallic material such as a Phosphor bronze alloy, for example, and has a central waist portion 18 and two beams 14 and 14' extending bilaterally therefrom. Each of the beams 14–14' is bifurated to form furcations 15—15 and 15'—15', respectively, which define slots 16–16' having predetermined width characteristics for receiving insulated conductors. Outermost end portions 21—21 and 21'—21' of the furcations 15—15 and 15'—15' are tapered to form V-shaped entrances 22–22' to the conductor-receiving slots 16–16'.

Figure 2:
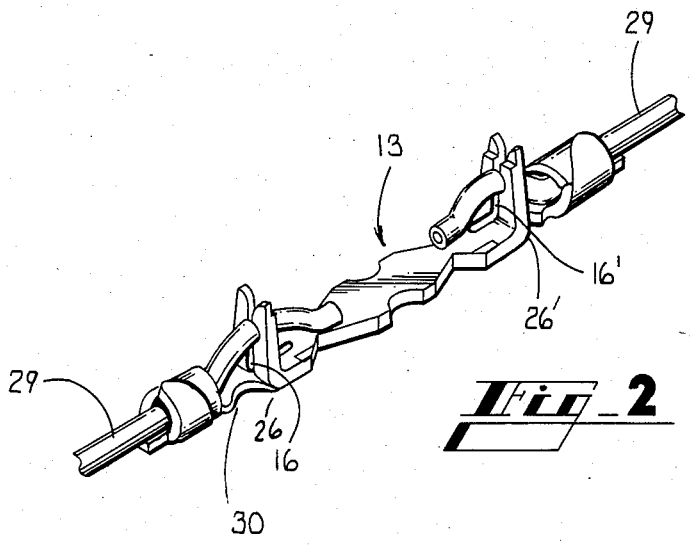
FIG. 2 is a perspective view of an electrical connecting system which includes the slotted beam contact element shown in FIG. 1B and mounted on a base.

Contact elements 13—13 having a bifurcated beam as shown, may be bent at locations 26–26' as shown in FIG. 1B between the beams 14–14' and the central waist portion 18 to provide a U-shaped contact element. Such a contact element may be attached to a base 30 (see FIG. 2) of a connector shown in U.S. Pat. No. 4,472,596 which was issued on Sept. 19, 1984 in the names of R. J. Brown, D. R. Fernandez and C. McGonigal and which is incorporated by reference hereinto. An insulated conductor 29 is moved into each of the slots 16–16' so that the conductors become connected electrically. Each insulated conductor typically includes a conductor covered with an insulation material such as, for example, polyethylene.

Referring now to FIG. 3, there is shown a sequence of steps of a method of this invention for providing a contact element 13 which has a conductor-receiving slot having a predetermined configuration. A strip 31 is punched to provide a contact element having the general configuration shown to the left in FIG. 3. Then tooling 33—33 is caused to be operated to engage edge surfaces of the furcations 15—15 and 15'—15' and cause relative movement therebetween until their free end portions 21—21 and 21'—21' are in proximate engagement with each other with the furcations defining slots therebetween. At a predetermined time with respect to the movement between the furcations, tooling (now shown in FIG. 3) is operated to apply forces to a major surface 35 of the strip adjacent to outer edge surfaces 37—37 of the already formed furcations at locations 38—38. The forces, which in a preferred embodiment are perpendicular to the strip, plastically reform and set the furcations. This causes the furcations of the contact element 13 to become reformed in that the furcations become disposed closer together and the slots 16–16' each are caused to have a predetermined configuration. It will be observed from FIG. 3 that the impressions at the locations 38—38 are disposed along a line which is transverse to a longitudinal axis of the contact element and which extends past an inner end of the slot 16 or 16'. The free end portions of the furcations 15—15 and 15'—15' may touch, but usually are spaced apart slightly. Damage to the entrance to each conductor-receiving slot is avoided.

In some instances, such as when the amount of movement of the furcations to a closed position is relatively small, the tooling 33—33 is not required. The movement of the furcations 15—15 and 15'—15' is accomplished by applying forces to at least one major surface 35 of the strip adjacent to the outer edge surfaces of the furcations at locations 38—38.

Figure 5:
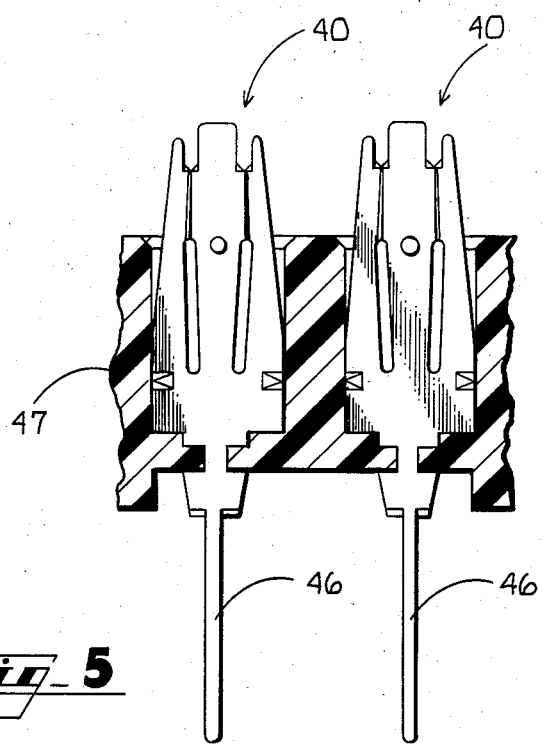
FIG. 5 is an elevational view partially in section which shows the contact element of FIG. 4 mounted in a block.

Another slotted beam contact element, designated generally by the numeral 40, is shown in FIG. 4 and is disclosed and claimed in U.S. Pat. No. 4,421,374 which issued on Dec. 20, 1983 in the names of L. Montillo and A. Uchuck. The contact element 40 is trifurcated and has lateral furcations 41—41 extending on either side of a center furcation 42 from a waist 43 with free end portions 44—44 forming entrances to conductor-receiving slots 45—45, and a tang 46 extending from the base portion for making, for example, a wire wrap connection. The trifurcated contact element may be mounted in a plastic block 47 such as is shown in FIG. 5.

In FIGS. 6A-6C are shown a sequence of views which illustrate steps of a method of this invention for making the contact element 40. FIG. 6A shows the contact element 40 after having been configured generally. FIG. 6B shows it after the lateral furcations 41—41 have been moved toward the center furcation 42, as shown by the arrows, until the free ends are in proximate engagement with each other with the lateral and the center furcations cooperating to form slots. At a predetermined time with respect to the movement of the lateral furcations, forces are applied to a major surface of the contact element adjacent to edge surfaces of the furcations at locations designated 48—48. This causes the furcations of the contact element to be reformed to provide conductor-receiving slots each having a predetermined configuration.

If desired, walls which define the conductor-receiving slots may be prestressed. This is done in accordance with the teachings in A. Logan U.S. Pat. No. 3,394,454 which issued on July 30, 1968 and which is incorporated by reference hereinto. Using that technique, the lateral furcations are caused to be closed on the center furcation and impressed at locations 48—48 as before. Then forces are applied at locations 49—49 (see FIG. 4) of the center furcation to cause the lateral furcations to be moved slightly apart to provide what is called a "forced gap".

The methods of this invention produce a slotted beam contact element 13, for example, with conductor-engaging surfaces which define the conductor-receiving slots 16—16 capable of being deformed controllably to a desired configuration. The controlled forming of the inner edge surfaces of the furcations is accomplished prior to the furcations being disposed in a final position relative to the waist. Predetermined width characteristics or configuration of the conductor-receiving slot 16 is interpreted to mean that the portions of the furcations 15—15, for example, may be spaced apart throughout the length thereof which defines the conductor-receiving slot, or for part of the length, or contiguous to each other. Further, the opposing surfaces of the furcations may be planar or stepped, for example.

Figures 7, 8:
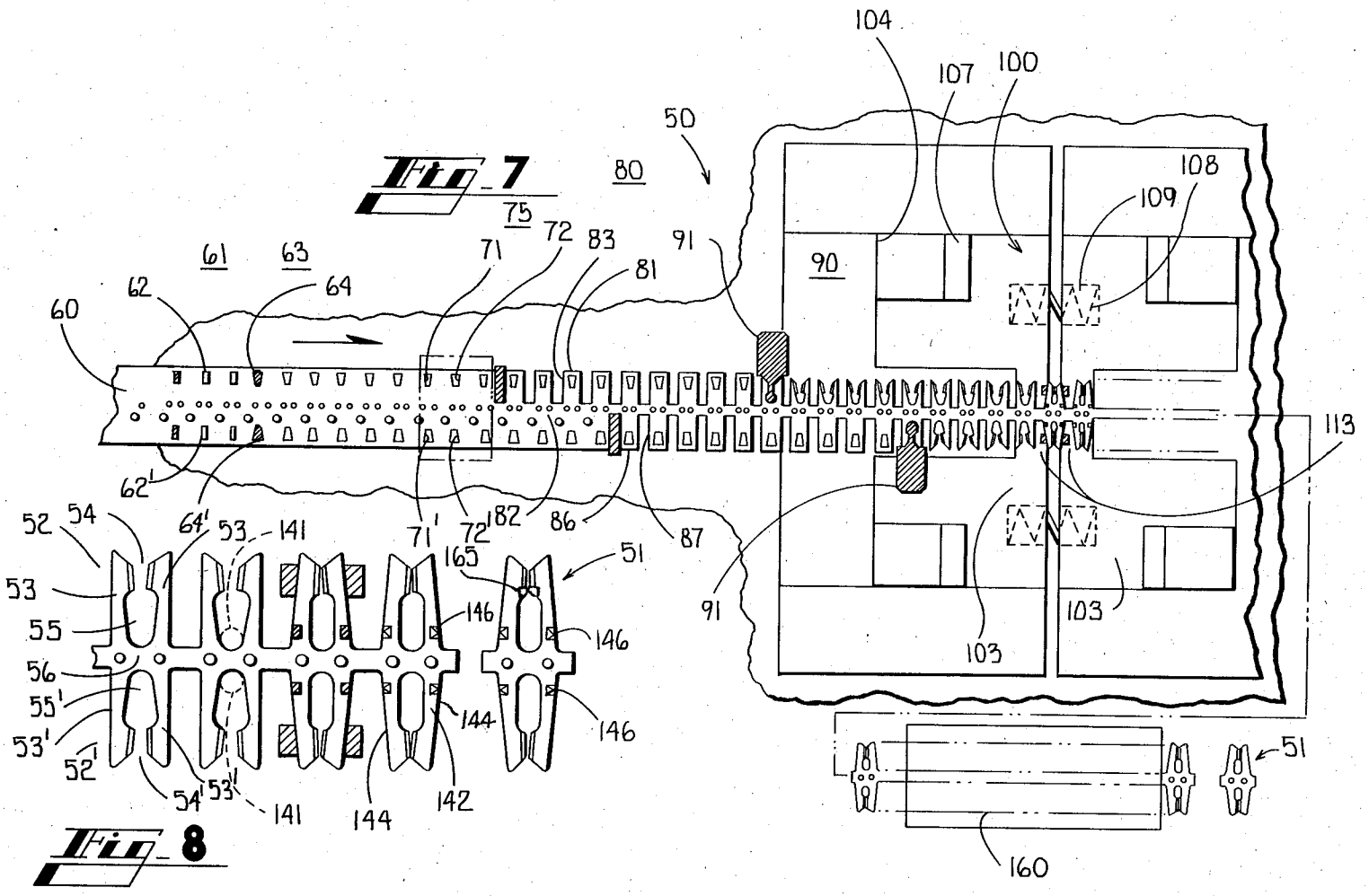
FIG. 7 is a plan view of an apparatus for forming a furcated beam contact element.
FIG. 8 shows an enlarged view of another type of furcated beam contact element in successive stages of manufacture with the apparatus of FIG. 7.

An apparatus, designated generally by the numeral 50 (see FIG. 7), is provided for manufacturing contact elements 51—51 (see also FIG. 8). Such contact elements are used in connector systems such as are shown in previously mentioned U.S. Pat. No, 3,858,158. Each contact element includes opposing beams 52-52' having furcations 53—53 and 53'—53' with slots 54 and 54' formed therebetween. Elongated slots 55 and 55' extend from a waist 56 to the slots 54 and 54'. It should be understood that a similar apparatus may be used to manufacture the contact elements 13 and 40.

As can best be seen in FIG. 7, a metallic strip 60 is advanced incrementally by an indexing mechanism (not shown) from left to right through a plurality of work stations, the first one of which is a station 61 whereat apertures 62-62' are formed on opposite sides of a longitudinal centerline of the strip. Then, successive sections of the strip 60 may be advanced into a station 63 whereat tools 64—64' are operated to deform, e.g. coin, at least portions of opposing surfaces 71-72 and 71'-72' of the apertures 62 and 62' respectively, which are destined to become the opposing inner edge surfaces of the furcations 53—53 and 53'—53' that define the slots 54-54'. Following the coining, the rough edges of the flowed metal may be trimmed; however, this step may be omitted in order to take advantage of the irregularities in the coined edges to enhance the electrical contact with a conductor which is moved into the slot 54 or 54'.

The spacing between the opposing surfaces 71-72 and 71'-72' of the apertures 62-62' is sufficient to permit the coining of the opposing inner edge surfaces of the furcations to a desired configuration and in some instances to permit a controlled plating of at least the surfaces destined to define the conductor-receiving slots. Also, in order to conform to acceptable metal forming practices and to avoid undue breakage of punches which are used to form subsequently the furcations 53—53 and 53'—53', the initial spacing between the opposing surfaces 71-72 and 71'-72' should be at least equal to the thickness of the strip 60. These requirements on the spacing between the opposing surfaces 71-72 and 71'-72' of the apertures 62-62' which become opposing surfaces of the furcations 53—53 and 53'—53' must be balanced against a desire to minimize the amount of movement of the furcations when they are moved from a "open" position to a "closed" position.

In the next step of a preferred embodiment of this invention, the strip 60 may be advanced incrementally through a station 75. There selected portions of the strip, e.g. opposing surfaces 71 and 72 and 71' and 72' of the apertures 62-62' may have a layer of suitable metallic material deposited thereon.

The strip 60 is advanced from the station 75 through a station 80 where one longitudinal edge portion of the strip is formed first with beams 81—81 extending from a central base 82 with spaces 83—83 therebetween, and the opposed edge portions formed with alternating beams 86—86 and spaces 87—87. The beams 81—81 and 86—86 are destined to become the beams 52 and 52', respectively, of each completed contact element 51, with the distance between successive ones of the beams 81—81 and 86—86 preferably equal at least to the thickness of the strip 60 to avoid undue punch breakage. Subsequently, the strip 60 of partially formed contact elements is advanced through a work station 90, where work tools 91—91 form the furcations 53—53 and 53'—53' while preserving the furcations in the "open" position spaced farther apart than in the final configuration.

The strip 60 is advanced to move the partially formed contact elements into a work station, designated generally by the numeral 100 (see FIG. 7), where the furcations are repositioned. The work station 100 includes a platen 101 (see FIG. 9A) for supporting a stationary plate 102 and a pair of plates 103—103 movable with respect to and mounted contiguous to the plate 102. Each of the plates 103—103 has an opening 104 defined partially by a camming surface 107 and which in the position shown in FIG. 9A is misaligned with an associated opening 106 in the stationary plate 102. Further, the plates 103—103 are held spaced apart in the direction of advance of the strip 50 by springs 108—108 disposed within blind bores 109—109 (see FIG. 7).

As the strip 60 is advanced incrementally through the station 100, it is supported slightly above the plate 103 (see FIG. 9A) by spring-loaded pins 111—111 mounted in bores 112—112. This permits the strip 60 to be advanced into and out of the work station 100 notwithstanding the protrusion of closing lugs 113—113 upstanding from and attached to the plates 103—103.

When the strip 60 is advanced incrementally, one of the partially formed contact elements 51—51 is positioned with the lugs 113—113 adjacent the beams 52-52' of the contact element as shown in FIG. 7. The location of the lugs 113—113, which in the arrangement in FIG. 7 are destined to move the furcations 53—53 and 53'—53', is determined with respect to the amount of movement required for the furcations.

A pair of stripper plates 116 and 117 (see FIG. 9A) having aligned openings 118 and 119, respectively, are mounted adjacent the plates 103—103 and spaced slightly therefrom to permit the strip 60 of partially formed contact elements 51—51 to be advanced between the plates 116 and 103. The openings 118 and 119 which are partially aligned with the openings 106 in the plate 102 and misaligned slightly from the openings 104—104 in the plates 103—103 are designed to receive camming members 121 and 122 depending from a reciprocally mounted ram 123. Further, the lowermost end of each member 121 and 122 has a rounded portion 124 and a camming surface 126 adapted to move slidably along the surface 107. A pair of compression springs 127—127 are interposed between the ram 123 and the stripper plate 117 so that when the ram 123 is moved downwardly, the members 121 and 122 are moved downwardly a distance prior to the lagging movement of the stripper plates 117 and 116.

In operation, one of the partially formed contact elements 51—51 of the strip 60 is positioned in alignment with the work station 100. The ram 123 is moved downwardly to urge the camming members 121 and 122 through the openings 119 and 118 in the juxtaposed stripper plates 117 and 116, respectively. This also causes the rounded portions 124—124 of the members 121 and 122 to enter the openings 104—104 in the movable plates 103—103 to overcome the springs 108—108 and cause the plates 103—103 to be moved toward each other (see FIG. 9B). The downward movement of the ram 123, after a predetermined lag occasioned by the springs 127—127, causes the plates 116 and 117 to be moved downwardly. The plate 116 overcomes the spring bias of the pins 111—111 and causes them to be moved into the bores 112—112 to permit the plate 116 to carry the strip 60 into confining engagement with the plates 103—103 (see FIG. 9B).

The movement of the plates 103—103 causes the closing lugs 113—113 to engage the beams 52-52' of the contact element 51 and causes portions of the bifurcated portions thereof on each side of the central base portion to be moved toward each other. In another embodiment, it has been found that the precision movement of the furcations 53—53 and 53'—53' is enhanced by inserting a pin 141 (see FIG. 8) into an innermost end of each of the slots 55-55' prior to the application of forces to the furcations.

At a predetermined time with respect to the relative movement between the furcations, they are set to more precisely define the conductor-receiving slots 54 and 54'. This is accomplished with punches which apply forces to at least one major surface 142 (see FIG. 8) of each contact element which coincides with the major surface of the strip at locations adjacent to outer edge surfaces 144—144 and aligned transversely in the vicinity of the inner ends of the slots 55-55'. The locations of the application of the applied forces are designated 146—146 in FIG. 8. For the contact elements shown in FIGS. 1A and 4, the impressions or work—hardened regions are designated by the reference numerals 38—38 and 48—48, respectively.

Figure 10:
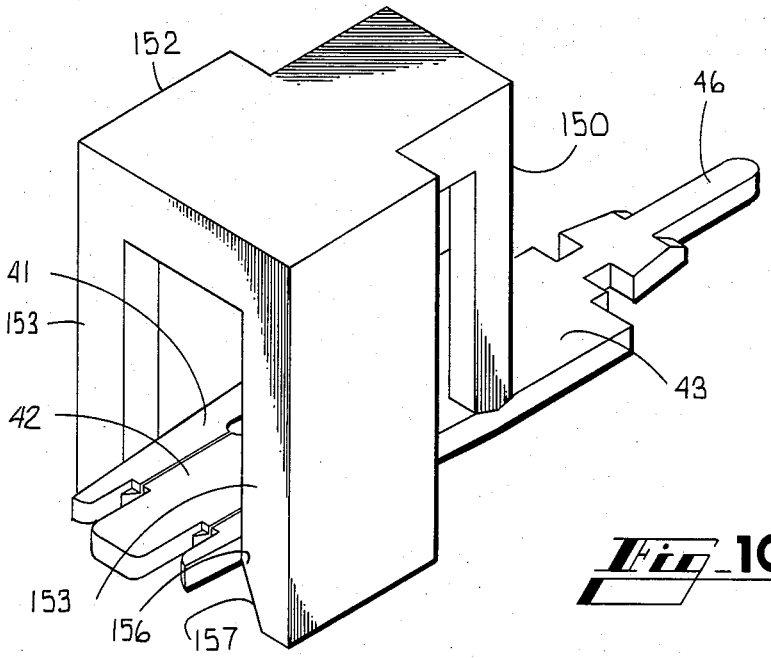
FIG. 10 is a perspective schematic view of an apparatus for causing relative movement between furcations and for applying forces to a major surface thereof.
Figure 11:
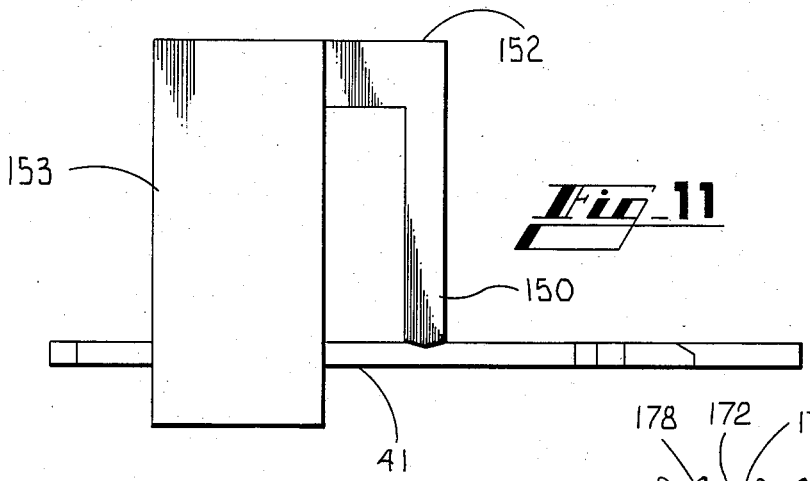
FIG. 11 is an elevational view of the apparatus of FIG. 10.

The forces are applied generally perpendicularly to at least one of the major surfaces of the strip 60 of partially formed contact elements and possibly to both. They may be applied by tools or apparatus which are conventional in the art such as for example, coining punches. The forces may be applied by punches 150—150 which are shown in FIGS. 10 and 11 and which are mounted on a frame 152. The frame 152 may be adapted also to support the depending portions 121 and 122 which are shown in FIG. 9A.

Figure 9B:
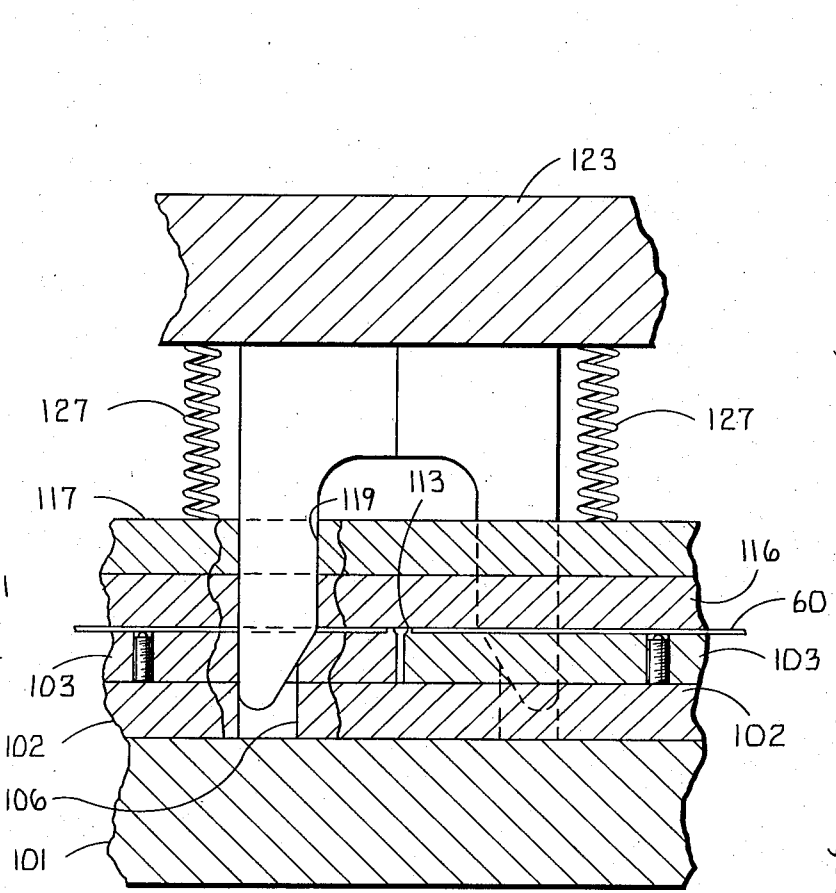
FIGS. 9A and 9B are enlarged detail views of a portion of the apparatus shown in FIG. 7 which is used to move furcations toward one another to form a slot having a predetermined configuration with FIG. 9B showing that portion of the apparatus in FIG. 9A after it has been operated to apply forces to the furcations.
Figure 9A:
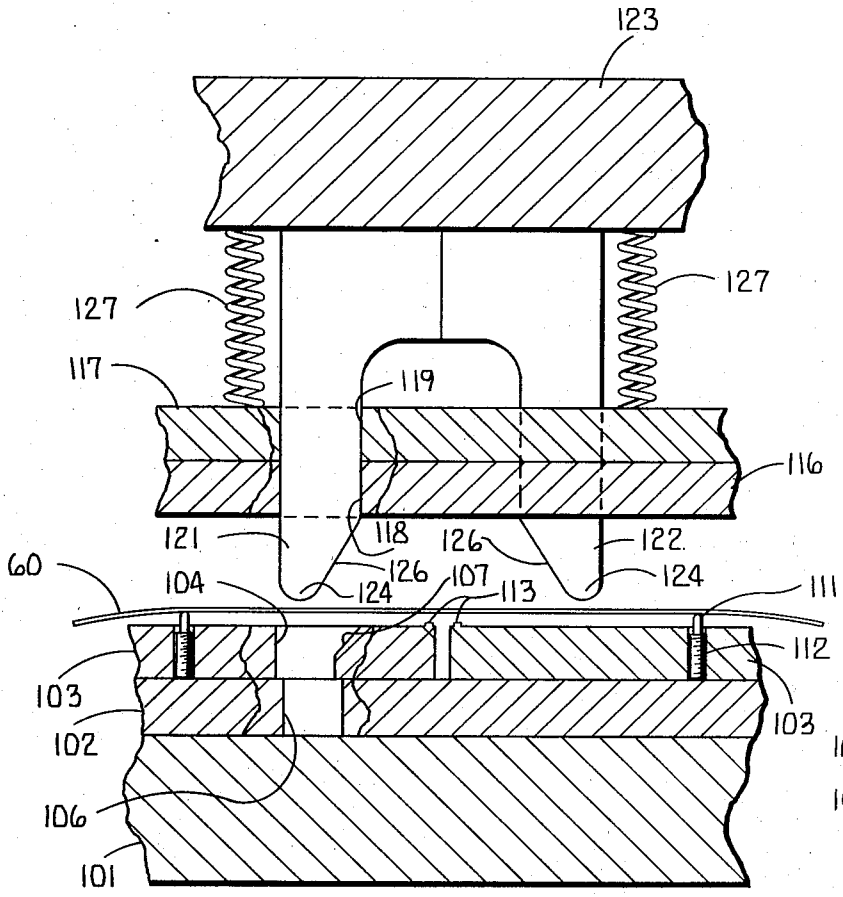

In a preferred embodiment, the furcations are moved directly by camming members which are supported by the frame 152 rather than by the lugs 113—113 which are shown in FIGS. 9A and 9B. In the preferred embodiment, the frame 151 also carries depending portions 153—153. The punches 150—150 and the frame 152 are shown in FIGS. 10 and 11 applying forces to a trifurcated contact element 40 of FIG. 6B. It should be observed from FIG. 11 that the punches 150—150 are arranged to become operative to impress a major surface of the furcations when the depending portions 153—153 are at a predetermined position with respect to the edge surfaces of the furcations. For example, they may be arranged to engage the major surface of the strip as upper ends 156—156 of camming portions 157—157 of the depending portions have been moved into engagement with the outer edge surfaces of the furcations. As such, the forces are applied to the major surface of the strip substantially near the completion of the relative movement between the furcations.

It also should be observed from FIGS. 10 and 11 that the camming portions 157—157 extend along and engage a substantial length of the furcations. They may terminate adjacent to the punches 150—150. Further, their engaging surfaces must be provided with a compound angle to engage the tapered furcation outer edge surfaces as the punch is moved downwardly as well as to cam the furcations toward each other.

It should be understood that for a relatively small movement of the furcations, neither the lugs 113—113 nor the depending portions 153—153 need be used. Instead, the relative movement between the furcations is caused by the punches 150—150.

As the ram 123 is moved upwardly to withdraw the depending portions 121 and 122 or 153—153 and the punches 150—150, the springs 108—108 are rendered effective to space apart the plates. After a predetermined lag, the springs 127—127 cause the stripper plates 116 and 117 to be moved to be rendered effective to raise the strip 60 out of engagement with the plates 103—103 so that the strip may be advanced to index the next successive partially formed contact element 51 into the work station 100.

Afterwards, the strip of contact elements 51—51 may be heat treated at a station 160. The finally configured contact elements 51—51 are then separated in seriatim from the strip 60 individually or in groups for insertion into any of several types of plastic blocks.

The methods of this invention also are ideally suited to being able to preload the slot-defining walls of a contact element while maintaining the desired slot characteristics. In the priorly-identified Logan U.S. Pat. No, 3,394,454, the slot walls are spaced apart by plastically deforming adjacent regions of the slot walls. By using the principles of this invention, the furcations may be closed to touch, as shown in FIG. 8, with forces further applied to the furcations as shown at locations designed 165—165 in FIG. 8 to further preload them and space them slightly apart.

While this invention is described in terms of a preferred embodiment which includes plating and heat treating as well as the shaping of opposing faces of the furcations, for example, the invention is not so limited. It may be used to make insulation-piercing, slotted beam contact elements which need not be plated, nor heat treated, nor require additional edge forming steps such as coining.

Figure 12:
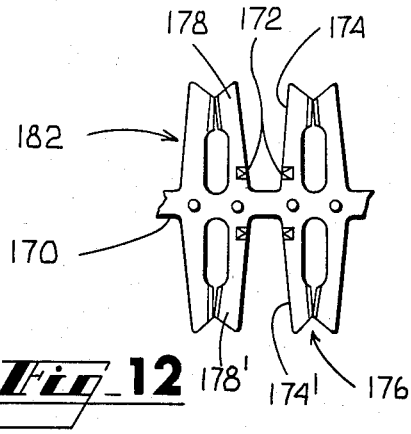
FIG. 12 is a plan view of another embodiment of the invention.

In the preferred embodiment and in its application to the manufacture of the contact elements shown in FIGS. 1A and 4, both furcations of each beam of the same contact element are impressed simultaneously by forces applied perpendicularly to the strip of metallic material. An alternative embodiment is shown in FIG. 12. There, as a strip 170 is advanced, coining punches form the impressions such as those designated 172—172 simultaneously on trailing furcations 174–174' of a leading contact element 176 and the leading furcations 178—178 of the next successive contact element 182. In this embodiment, one furcation of each beam of each of two successive contact elements is moved toward the other furcation of the same beam.

It is to be understood that the above-described arrangements are simply illustrative of the invention. Other arrangements may be devised by those skilled in the art which will embody the principles of the invention and fall within the scope and spirit thereof.

What is claimed is:

1. A method of making a slotted beam contact element, said method comprising the steps of:

forming an opening in a strip of metallic material having major surfaces which are connected by edge surfaces;

forming a furcated beam in the strip with the furcations of the beam being spaced apart and with the opening being disposed between at least portions of inner edge surfaces of the furcations; and applying forces to at least one of the major surfaces at a location adjacent to an outer edge surface of at least one furcation to cause relative movement between the furcations to reduce the spacing therebetween and cause the portions of the inner edge surfaces to define a conductor-receiving slot having a predetermined configuration.

2. A method of making a slotted beam contact element, said method comprising the steps of:

forming an opening in a metallic strip having major surfaces which are connected by edge surfaces of the strip;

forming a furcated beam in the strip with the furcations of the beam being spaced apart and with the opening being disposed between at least portions of facing inner edge surfaces of the furcations;

causing relative movement between the furcations to reduce the spacing therebetween and to cause the portions of the inner edge surfaces between which is disposed the opening to define a slot for receiving a conductor and free end portions of the furcations to define an entrance to the conductor-receiving slot, said step of causing relative movement being accomplished by the application of forces to outer edge surfaces of the furcations; and applying forces to at least one of the major surfaces at locations adjacent to outer edge surfaces of the furcations to cause the slot which is defined by the furcations to have a predetermined configuration.

3. The method of claim 2, wherein the step of applying forces causes the forces to be directed perpendicularly of the strip.

4. The method of claim 2, wherein the locations at which the forces are applied are disposed along a line transverse to the longitudinal axis of the contact element and extending past an inner end of the slot.

5. The method of claim 2, wherein the forces are applied at a predetermined time with respect to the relative movement between the furcations.

6. The method of claim 2, wherein the furcated beam extends from a waist portion of the contact element and the forces are applied at a location in the vicinity of the junction of the furcations and the waist portion.

7. A method of making a slotted beam contact element, said method comprising the steps of:

indexing a strip of metallic material through a plurality of work stations;

forming successive openings on each side of a longitudinal centerline of the strip, each opening including a pair of opposing surfaces which are destined to define a conductor-receiving slot;

working the strip to form successive interconnected partially formed contact elements, each having a waist with a bifurcated beam extending from opposite sides of the waist such that opposing inner edge surfaces of the furcations of each beam which are destined to form a conductor-receiving slot encompass an aligned, associated, one of the openings and provide an enlarged slot which is disposed between the opposing edge surfaces destined to form the conductor-receiving slot and the waist;

moving the furcations of each beam toward each other by applying forces to outer edge surfaces of the furcations; and applying forces to at least one major surface of the furcations at locations adjacent to outer edge surfaces to provide a contact element having furcations which define conductor-receiving slots therebetween of predetermined width characteristics suitable for causing the furcations to establish electrical contact with conductors which are moved into the conductor-receiving slots.

8. An apparatus for making a slotted beam contact element, said apparatus comprising:

support means for holding a metallic strip having major surfaces which are connected by edge surfaces extending along the thickness of the strip;

means operatively associated with said support means for forming an opening in the strip of metallic material;

means operatively associated with said support means and with the forming means for forming a furcated beam in the strip with the furcations of the beam being spaced apart and with the opening being disposed between at least portions of inner edge surfaces of the furcations; and means operatively associated with said support means for applying foreces to the furcations along at least one of the major surfaces at locations adjacent to an outer edge surface of at least one furcation to cause relative movement between the furcations to reduce the spacing therebetween and cause the portions of the inner edge surfaces to define a conductor-receiving slot having a predetermined configuration.

9. An apparatus for making a slotted beam contact element, said apparatus comprising:

support means for holding a metallic strip;

first forming means operatively associated with said support means for forming an opening in the metallic strip having major surfaces which are connected by edge surfaces extending along the thickness of the strip;

second forming means operatively associated with said first forming means and said support means and rendered effective subsequent to the operation of said first forming means for forming a furcated beam in the strip with the furcations of the beam being spaced part and with the opening being disposed between at least portions of facing inner edge surfaces of the furcations;

means rendered effective subsequent to the operation of said second forming means and operatively associated with said support means for applying forces to outer edge surfaces of the furcations to cause relative movement between the furcations to reduce the spacing therebetween and to cause the portions of the inner edge surfaces to define a slot for receiving a conductor and free end portions of the furcations to define an entrance to the conductor-receiving slot; and means operatively associated with said support means for applying forces to the furcations along one of the major surfaces at locations adjacent to outer edge surfaces of the furcations to cause the slot which is defined by the furcations to have a predetermined configuration suitable for receiving a conductor and for causing electrical contact to be established between the furcations and the conductor.

10. The apparatus of claim 9, wherein said means for applying forces causes the forces to be applied perpendicular to the strip and at a predetermined time with respect to the relative movement between the furcations.

11. The apparatus of claim 9, wherein said means for applying forces causes forces to be applied to the furcations at locations along a line which is transverse to the longitudinal axis of the contact element and which passes adjacent to an inner end of the slot.

12. An apparatus for making a slotted beam electrical contact element, said apparatus comprising:

support means for holding a strip of metal;

means for indexing the strip of metal along said support means through a plurality of work stations;

means operatively associated with said support means for forming successive openings on each side of a longitudinal centerline of the strip, each opening including a pair of opposing walls which are destined to define a conductor-receiving slot;

means disposed along said support means at one of the work stations for working the strip to form successive interconnected partially formed contact elements, each having a waist with a bifurcated beam extending from opposite sides of the waist and aligned with and encompassing one of the openings such that the opposing walls of each opening form the opposing surfaces of the furcations of the beam which encompass the opening with the furcations of each beam being spaced apart and with enlarged slots extending from the walls destined to form the conductor-receiving slots to the waist;

means operatively associated with said indexing means for applying forces to outer edge surfaces of the furcations to move the furcations of each beam toward each other; and means operatively associated with said indexing means and rendered effective at a predetermined time with respect to the movement of the furcations of each beam toward each other for applying forces perpendicularly of the strip along a major surface of the strip at locations adjacent to outer edge surfaces of the furcations to define conductor-receiving slots of predetermined width characteristics suitable for causing the furcations of each beam to establish electrical contact with conductors that are moved subsequently into the conductor-receiving slots.

13. The apparatus of claim 12, wherein forces are applied to each beam at locations along a line transverse of the longitudinal axis of the contact element and extending through the vicinity of the intersection of the enlarged slot of said beam and the waist.

* * * * *